US009869092B1

(12) United States Patent
Rush

(10) Patent No.: US 9,869,092 B1
(45) Date of Patent: Jan. 16, 2018

(54) ADJUSTABLE REBAR POSITIONING DEVICE

(71) Applicant: Michael G. Rush, Sioux City, IA (US)

(72) Inventor: Michael G. Rush, Sioux City, IA (US)

( * ) Notice: Subject to any disclaimer, the term of this patent is extended or adjusted under 35 U.S.C. 154(b) by 0 days.

(21) Appl. No.: 15/427,532

(22) Filed: Feb. 8, 2017

(51) Int. Cl.
*E04C 5/16* (2006.01)

(52) U.S. Cl.
CPC ..... *E04C 5/168* (2013.01); *E04C 5/161* (2013.01); *E04C 5/165* (2013.01); *E04C 5/167* (2013.01)

(58) Field of Classification Search
CPC ..... E04C 5/168; E04C 5/161; E04C 5/165; E04C 5/167
See application file for complete search history.

(56) References Cited

U.S. PATENT DOCUMENTS 1,086,732 A 2/1914 Schoenthaler
1,986,528 A * 1/1935 Ranger ..... E04C 5/166 403/400
3,197,171 A * 7/1965 Hillard ..... E04C 5/168 249/40
3,512,329 A 5/1970 Du Plessis
3,722,849 A 3/1973 Luyben
4,358,080 A * 11/1982 Wolker ..... F16B 37/0842 174/166 R
4,550,891 A * 11/1985 Schaty ..... A61B 21/071 174/166 R
5,050,358 A 9/1991 Vladislavic
5,140,794 A 8/1992 Miller
5,271,587 A * 12/1993 Schaty ..... F16L 3/2235 248/68.1
5,351,920 A * 10/1994 Decky ..... F16L 3/13 248/222.52
5,371,991 A * 12/1994 Bechtel ..... E04C 5/167 24/336
5,598,682 A * 2/1997 Haughian ..... E04C 5/163 403/346
5,626,436 A * 5/1997 Dragone ..... E04C 5/167 24/339
5,678,375 A 10/1997 Juola
5,809,725 A * 9/1998 Cretti ..... E04B 2/8647 52/309.15
5,813,185 A * 9/1998 Jackson ..... E04C 5/16 411/427
5,878,546 A * 3/1999 Westover ..... E04C 5/167 24/329
6,102,341 A * 8/2000 Ball ..... F16L 3/133 248/58
6,161,360 A * 12/2000 Smith ..... E04C 5/167 52/165

(Continued)

FOREIGN PATENT DOCUMENTS

DE 19819774 11/1999

*Primary Examiner* — Adriana Figueroa
(74) *Attorney, Agent, or Firm* — Jeffrey A. Proehl; Woods, Fuller, Shultz & Smith P.C.

(57) ABSTRACT

A rebar positioning device with opposite ends for positioning adjacent to a form face of at least one form panel may include a support rod having opposite ends and an outer surface, with at least a portion of the outer surface being threaded. At least one bar clip may be movably mounted on the support rod. An orientation of the at least one bar clip on the support rod is adjustable, and a position of the at least one bar clip on the support rod is adjustable.

8 Claims, 3 Drawing Sheets

(56) References Cited

U.S. PATENT DOCUMENTS

| | | | | |
|---|---|---|---|---|
| 6,224,025 | B1 * | 5/2001 | Alvarez | F16L 3/11 24/339 |
| 6,631,876 | B1 * | 10/2003 | Phillips | A16B 2/22 248/229.16 |
| 7,082,732 | B2 | 8/2006 | Titishov | |
| 7,143,554 | B2 | 12/2006 | Sachs | |
| 7,559,532 | B1 * | 7/2009 | Kodi | E04C 5/163 254/21 |
| 7,934,693 | B2 * | 5/2011 | Bravinski | E04B 2/8647 249/216 |
| 8,602,365 | B2 * | 12/2013 | Neace | H02G 3/32 248/215 |
| 8,776,328 | B2 * | 7/2014 | Kodi | E04C 5/163 24/339 |
| 9,021,763 | B2 * | 5/2015 | Rush | E04C 5/18 52/677 |
| 9,091,372 | B2 * | 7/2015 | Lacour | F16L 3/133 |
| 2003/0029130 | A1 | 2/2003 | Humphrey | |
| 2003/0115825 | A1 | 6/2003 | Crump | |
| 2004/0040247 | A1 * | 3/2004 | Morse | E04C 5/166 52/649.8 |
| 2005/0217198 | A1 * | 10/2005 | Carraher | E04C 5/163 52/719 |
| 2005/0230582 | A1 * | 10/2005 | Birli | F16B 2/065 248/229.11 |
| 2006/0248843 | A1 | 11/2006 | Zapata | |
| 2007/0068105 | A1 | 3/2007 | Given | |
| 2007/0209310 | A1 | 9/2007 | Papke | |
| 2013/0104482 | A1 | 5/2013 | Boese | |
| 2014/0157704 | A1 | 6/2014 | McDonagh | |
| 2016/0032580 | A1 | 2/2016 | Rahimzadeh | |

* cited by examiner

ADJUSTABLE REBAR POSITIONING DEVICE

BACKGROUND

Field

The present disclosure relates to concrete forming apparatus and more particularly pertains to a new adjustable rebar positioning device for positioning reinforcement bars with respect to a form in a form cavity in a highly adjustable manner.

SUMMARY

In one aspect, the present disclosure relates to a rebar positioning device with opposite ends for positioning adjacent to a form face of at least one form panel. The positioning device may comprise a support rod having opposite ends and an outer surface, and at least a portion of the outer surface is threaded. The device may also comprise at least one bar clip movably mounted on the support rod. An orientation of the at least one bar clip on the support rod may be adjustable, and a position of the at least one bar clip on the support rod is adjustable.

In another aspect, the disclosure relates to a reinforcing system for concrete which may comprise at least one form panel having a form face and a concrete receiving space adjacent to the form face, and a plurality of reinforcing bars being positioned in the concrete receiving space. The system may also comprise a rebar positioning device with opposite ends, with one of the ends being positioned adjacent to the form face of the form panel. The positioning device may comprise a support rod having opposite ends and an outer surface, with at least a portion of the outer surface being threaded, and at least one bar clip movably mounted on the support rod. An orientation of the at least one bar clip on the support rod may be adjustable, and a position of the at least one bar clip on the support rod is adjustable.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
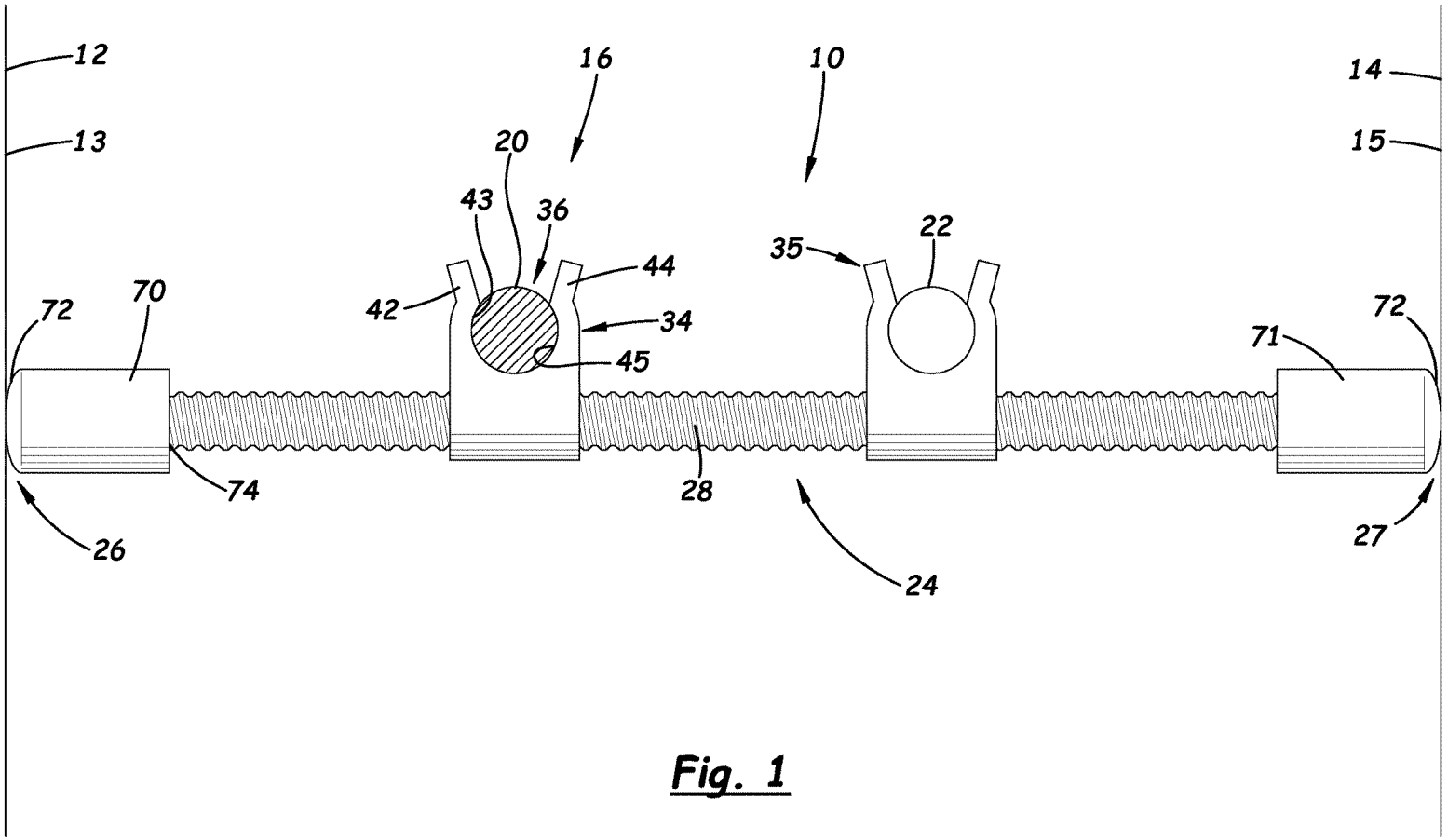
FIG. 1 is a schematic top view of a system for reinforcing concrete including an illustrative embodiment of a new adjustable rebar positioning device according to the present disclosure.
Figure 2:
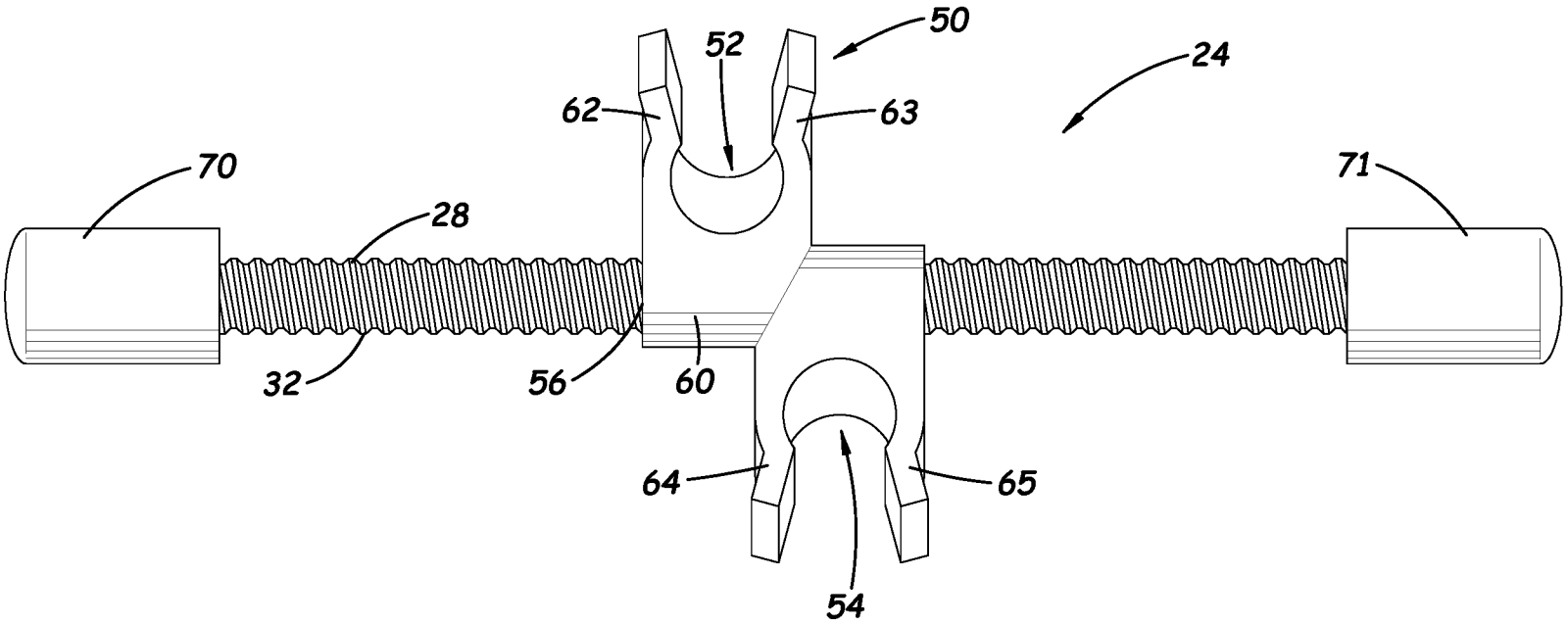
FIG. 2 is a schematic top view of an illustrative embodiment of the adjustable rebar positioning device.
Figure 3:
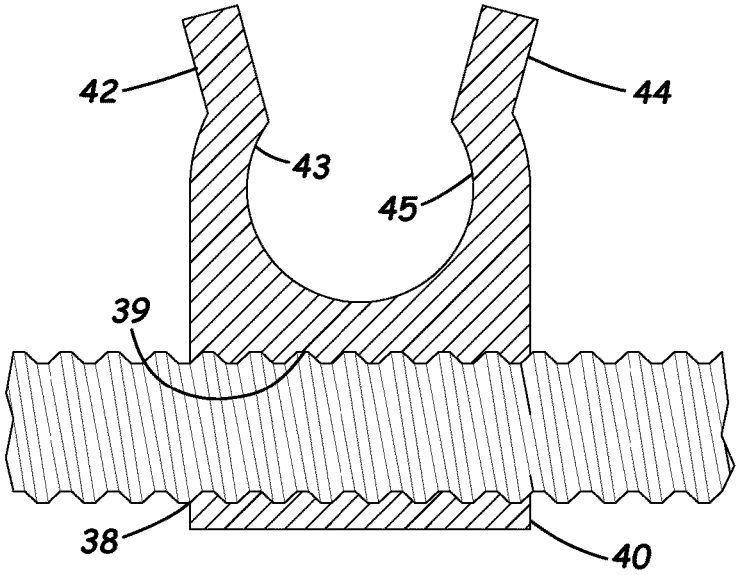
FIG. 3 is a schematic sectional view of a bar clip and a portion of the support rod of the rebar positioning device, according to an illustrative embodiment.
Figure 4:
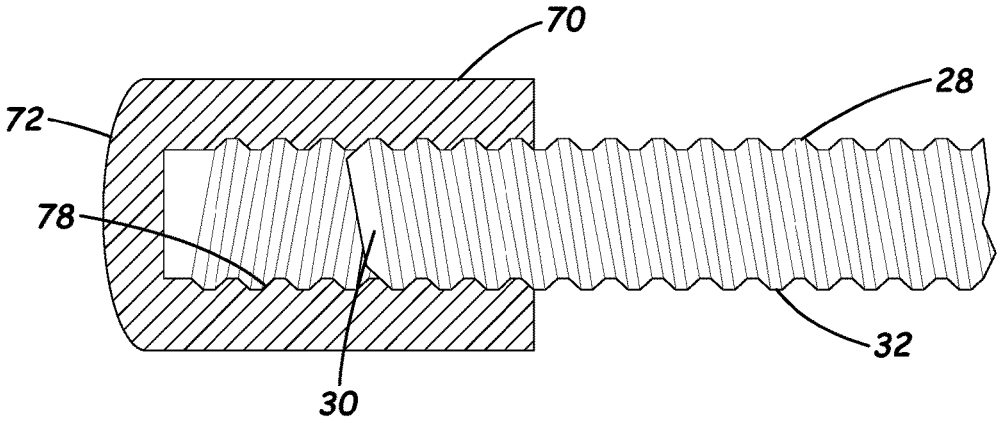
FIG. 4 is a schematic sectional view of the an abutment cap and a portion of the support rod of the rebar positioning device, according to an illustrative embodiment.

With reference now to the drawings, and in particular to FIGS. 1 through 4 thereof, a new adjustable rebar positioning device embodying the principles and concepts of the disclosed subject matter will be described.

In the field of placing concrete, and in particular forming concrete walls and other slab-like structures, the embedding of reinforcement bar, or "rebar", in the concrete is common to enhance the strength of the concrete. The rebar is often assembled into a grid in two or three dimensions that is positioned in a space formed by concrete form panels that define the boundaries of the wall or other structure to be produced. Concrete is introduced into the space between the faces of the form panels and is encouraged to flow about the rebar structure located in space. The correct positioning of the rebar structure in the form space, and ultimately in the concrete wall or slab, is important to the ultimate strength of the concrete and its fitness for the intended purpose. Improper positioning of the rebar prior to concrete placement, as well as movement of the rebar structure during concrete placement, can impair the reinforcement functionality of the rebar.

Many different devices have been proposed to position or help position rebar in the form space. As an example, the applicant invented a device disclosed in U.S. Pat. No. 9,021,763, issued May 5, 2015, which is highly useful for helping to position rebar within the form space prior to and during concrete placement. The applicant is also recognized that while devices that utilize fixed dimensions for fixed positioning of rebar in the form space are useful, further benefit would be gained from providing a degree of adjustability in the dimensions of the device to provide greater flexibility of rebar spacing utilizing a single device size, as well as adjusting to variations encountered in the field where form panels and rebar mats are not perfect. For example, the spacing between the faces of the form panels may vary along the form structure, and it would be desirable to be able to adjust the device to accommodate such variances. Further, the positioning of the rebar with respect to the faces of the form panels may also need to be adjusted in the field. The ability to adjust various aspects of the rebar positioning device thus allows one device size to accommodate a variety of form panel configurations, while also allowing adjustments to be made in the field.

In one aspect, the disclosure relates to a system 10 for forming and pouring concrete to form a structure, such as a concrete wall, but may be used for forming other concrete structures. The system 10 may include a form structure including at least one form panel 12 which has a form face 13 to form a boundary for poured or placed concrete. For structures such as walls, a pair of the form panels 12, 14 may be employed with the form faces 13, 15 in a substantially opposing relationship. The form faces 13, 15 may define a concrete receiving space 16 therebetween, and often the form faces are oriented substantially parallel to each other although other relationships may be utilized.

The system 10 may also include a reinforcing structure for the concrete that is embedded in the concrete during placing the concrete. The reinforcing structure may include a plurality of reinforcing bars 20, 22 which may be positioned in the concrete receiving space 16 between the panels 12, 14 of the form structure so as to be covered by and embedded in the concrete when the concrete is poured or placed into the concrete receiving space 16. The reinforcing bars 20, 22 may be spaced from each other, and the reinforcing bars may be oriented substantially parallel to each other and/or may be oriented substantially perpendicular to each other. In many implementations, the reinforcing bars are formed into one or more "mats" formed by bars that are positioned substantially in a single plane and may be attached to each other. The bars of the mat may be oriented such that some bars are oriented parallel to each other and other bars cross each other in the single plane, so as to somewhat resemble a woven mat.

The reinforcing system 10 may also include at least one rebar positioning device 24 which may be configured to position and/or orient one or more of the reinforcing bars 20, 22 with respect to each other and with respect to the concrete receiving space 16 or the form face or faces 13, 15 of the form panel or panels. The rebar positioning device 24 may include a support rod 28 with opposite ends 30. The support rod has an outer surface 32 and at least a portion of the outer surface of the support rod may be threaded or provided with threads. In some embodiments, substantially an entirety of the outer surface of the rod is threaded, although partial threading may be utilized.

The rebar positioning device 24 may also include at least one bar clip 34 which is configured to engage a reinforcement bar to hold the position of the bar with respect to the support rod 28, and thus the position of the bar or bars with respect to the space 16 and form panels 12, 14. The bar clip 34 may be movably mounted on the support rod 28 such that an orientation of the bar clip on the support rod may be adjustable, and/or such that the position of the bar clip on the support rod may also be adjustable. The bar clip 34 may have a cavity 36 which is configured to receive a portion of the reinforcing bar, and may be configured to removably receive the portion of the bar.

The bar clip may also have a channel 38 which is configured to receive a portion of the support rod 28. The channel 38 may be defined by a channel surface 39, at least a portion of the channel surface may be threaded to engage threads formed on the outer surface of the support rod such that the clip is rotatably movable and translationally movable with respect to the rod. Rotation of the bar clip with respect to the support rod in a first rotational direction causes the bar clip to move in a first longitudinal direction with respect to the support rod to move the cavity 36 in the first longitudinal direction. Rotation of the bar clip with respect to the support rod 28 in a second rotational direction may cause the bar clip to move in a second longitudinal direction with respect to the support rod to move the cavity 36 in the second longitudinal direction. The position and orientation of the clip 34 with respect to the support rod is thus fixed by the interlock of the threads on the clip with the threads on the support rod such that changing the position and orientation of the clip may require rotation of the clip with respect to the support rod.

In some embodiments, the bar clip may comprise a base portion 40 which defines the channel 38, and a pair of arm portions 42, 44 which extend from the base portion 40 to form the cavity 36 between the arm portions. The arm portions 42, 44 may extend in substantially the same direction from the base portion, and may have opposing clasping services 43, 45. The clasping services 43, 45 may diverge and converge to provide a snap fit of the clip on a reinforcing bar positioned between the arm portions. The sizing of the gap between the clasping surfaces may be varied to fit different sizes (e.g., diameters) of reinforcing bars. In some embodiments, two or more of the bar clips 34, 35 may be mounted on the support rod and may each be independently orientable with respect to each other and with respect to the support rod, and may be independently positionable with respect to each other and with respect to the support rod.

In some embodiments, the rebar positioning device 24 may include at least one double bar clip 50 which is movably mounted on the support rod 28. The orientation of the double bar clip 50 on the support rod may be adjustable, and/or a position of the double bar clip on the support rod may be adjustable. The double bar clip may have a pair of cavities 52, 54 which are configured to each receive a portion of a respective reinforcing bar. The cavities 52, 54 may be configured to support reinforcing bars positioned at an angle with respect to each other, and the angle may in some embodiments be substantially parallel (e.g., approximately 0 degrees), substantially perpendicular (e.g., approximately 90 degrees) or any other angle. In some illustrative embodiments, angles may be utilized in a range, for example, of between approximately 30 degrees and approximately 150 degrees. The angle between the cavities may be fixed, or may be adjustable.

The double bar clip 50 may have a channel 56 which is configured to receive the support rod 28, and the channel may be defined by a channel surface which may be at least partially threaded to engage threads on the support rod. The threaded engagement between the double bar clip and the support rod may permit rotation of the double bar clip with respect to the support rod to cause the bar clip to move in a first longitudinal direction with respect to the support rod when the bar clip is rotated in the first rotational direction which thereby moves the cavities in the first longitudinal direction. Rotation of the double bar clip with respect to the support rod in a second rotational direction causes the double bar clip to move in a second longitudinal direction with respect to the support rod to thereby move the cavities in the second longitudinal direction. The position and orientation of the double bar clip 50 with respect to the support rod 28 is thus fixed by the interlock of the threads on the clip 50 with the threads on the support rod such that changing the position and orientation of the clip may require rotation of the clip with respect to the support rod.

The double bar clip 50 may comprise a base portion 60 which defines the channel 56, and two pairs of arm portions 62, 63, 64, 65 each extending from the base portion 62 form the cavities 52, 54 between pairs of the arm portions. Each pair of arm portions may extend in substantially the same direction from the base portion, and the pairs of arm portions may have opposing clasping surfaces.

The rebar positioning device 24 may further include an abutment cap 70 mounted on an end 30 of the support rod, and may include another abutment cap 71 mounted on the other end of the support rod. The position of the abutment cap may be adjustable with respect to the support rod and with respect to each other. Each of abutment caps 70, 71 may have an abutment face 72, and adjustment of the position of the abutment caps 70, 71 may effectively adjust the distance between the abutment faces 72 of the caps. The abutment cap may define a cavity 74 for receiving an end portion 76 of the support rod, and the cavity may be positioned opposite of the abutment face 72 on the cap. The cavity 74 may be defined by a cavity surface 78, and at least a portion of the cavity surface may be threaded to engage threads on the support rod such that rotation of the abutment cap with respect to the support rod in a first rotational direction causes the cap to move outwardly with respect to the support rod to thereby move the abutment face outwardly, and rotation of the abutment cap with respect to the support rod in a second rotational direction causes the cap to move inwardly with respect to the support rod to thereby move the abutment face inwardly.

In use, the overall length of the device may be adjusted by rotating one or both of the abutment caps with respect to the support rod to conform to, for example, the actual spacing between the faces of the form panels. Further, the position of a rebar engaged by one of the bar clips of the device with respect to the face of a form may be adjusted by rotating either the abutment cap (abutting the form face) or rotating the bar clip, or rotating both elements with respect to the support rod. Also, the positioning or spacing between rebar (or mats of rebar) may be adjusted by rotating (with respect to the support rod) one or both of the bar clips engaging the rebar.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A reinforcing system for concrete, comprising:

at least one form panel having a form face and a concrete receiving space adjacent to the form face;

a plurality of reinforcing bars being positioned in the concrete receiving space; and a rebar positioning device with opposite ends, one of the ends being positioned adjacent to the form face of the form panel, the positioning device comprising:

a support rod having opposite ends and an outer surface, at least a portion of the outer surface being threaded;

at least one bar clip rotatably mounted on the support rod, the clip having a base portion receiving a section of the support rod and a pair of arm portions removably gripping one of the reinforcing bars, the arm portions extending outwardly from the base portion such that the arm portions extend in a radial direction from the support rod;

wherein the at least one bar clip is rotatable on the support rod to adjust the radial direction orientation of the arm portions of the bar clip with respect to the support rod; and wherein the at least one bar clip is rotatable on the support rod to adjust a longitudinal position of the bar clip relative to the opposite ends of the support rod.

2. The system of claim 1 wherein the at least one form panel comprises a pair of form panels with substantially opposing form faces, the form faces defining the concrete receiving space therebetween, the opposite ends of the rebar positioning device being each located adjacent to the one of the form faces.

3. The system of claim 1 wherein the at least one bar clip is mounted on the support rod such that rotation of the clip with respect to the support rod changes both the radial direction orientation of the clip with respect to the support rod and the position of the clip between the ends of the support rod.

4. The system of claim 1 wherein the at least one bar clip is threadedly mounted on the support rod such that rotation of the clip with respect to the support rod in a first rotational direction advances the bar clip in a first longitudinal direction along the support rod and rotation of the bar clip with respect to the support rod in a second rotational direction advances the bar clip in a second longitudinal direction along the support rod, the second longitudinal direction being opposite of the first longitudinal direction.

5. The system of claim 1 wherein the at least one bar clip has a cavity configured to receive a portion of a reinforcing bar and a channel configured to receive the support rod.

6. The system of claim 5 wherein the channel is threaded to engage threads on the support rod such that rotation of the bar clip with respect to the support rod in a first rotational direction causes the bar clip to move in a first longitudinal direction with respect to the support rod to move the cavity in the first longitudinal direction and rotation of the bar clip with respect to the support rod in a second rotational direction causes the bar clip to move in a second longitudinal direction with respect to the support rod to move the cavity in the second longitudinal direction, the second longitudinal direction being opposite of the first longitudinal direction.

7. The system of claim 1 additionally comprising an abutment cap mounted on at least one end of the support rod and having an abutment face, a longitudinal position of the abutment cap on the support rod being adjustable to adjust a longitudinal position of the abutment face with respect to the support rod.

8. The system of claim 7 wherein the abutment cap defines a cavity receiving an end portion of the support rod, the cavity being defined by a cavity surface threaded to engage threads on the support rod such that rotation of the abutment cap with respect to the support rod in a first rotational direction causes the cap to move longitudinally outward with respect to the support rod and thereby move the abutment face longitudinally outward, and rotation of the abutment cap with respect to the support rod in a second rotational direction causes the cap to move longitudinally inward with respect to the support rod to move the abutment face longitudinally inward.

* * * * *